US006220475B1

(12) United States Patent
Nayar et al.

(10) Patent No.: US 6,220,475 B1
(45) Date of Patent: Apr. 24, 2001

(54) EXPANDED CANS

(75) Inventors: Sudesh Kumar Nayar, Wilishire; Bruce John Munn, Oxfordshire, both of (GB)

(73) Assignee: Crown Cork & Seal Technologies Corporation, Alsip, IL (US)

( * ) Notice: Subject to any disclaimer, the term of this patent is extended or adjusted under 35 U.S.C. 154(b) by 0 days.

(21) Appl. No.: 09/601,613

(22) PCT Filed: Jan. 20, 1999

(86) PCT No.: PCT/GB99/00195

§ 371 Date: Aug. 4, 2000

§ 102(e) Date: Aug. 4, 2000

(87) PCT Pub. No.: WO99/39981

PCT Pub. Date: Aug. 12, 1999

(30) Foreign Application Priority Data

Feb. 4, 1998 (GB) ..... 9802264

(51) Int. Cl.[7] ..... B65D 7/42

(52) U.S. Cl. ..... 220/674; 220/675; 220/669

(58) Field of Search ..... 220/670, 671, 220/672, 673, 674, 675, 669

(56) References Cited

U.S. PATENT DOCUMENTS 3,335,902 * 8/1967 Javorik .
4,050,605 * 9/1977 Wakana et al. ..... 200/674
5,100,017 * 3/1992 Ishnabe et al. ..... 220/674
5,178,289 * 1/1993 Krishnakumar et al. ..... 220/674

FOREIGN PATENT DOCUMENTS

044618A * 8/1991 (EP) .
9640457A * 12/1996 (WO) .

* cited by examiner

*Primary Examiner*—Joseph M. Moy
(74) *Attorney, Agent, or Firm*—Diller, Ramik & Wight

(57) ABSTRACT

Metal can blanks comprising a cylindrical side wall expanded by any known method so that the side wall of the resultant can includes a regular pattern (2) of individual pattern elements. In one example the pattern elements are diamond in outline and are formed over a central region of the can side wall by about 2.25% expansion. Further expanded margins (3, 4) are provided above and below this pattern. The pattern elements are arranged in rows and columns so that the pattern comprises at least two rows and at least two columns.

10 Claims, 2 Drawing Sheets

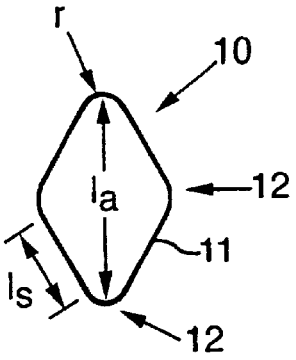
Fig.2.
Fig.3.
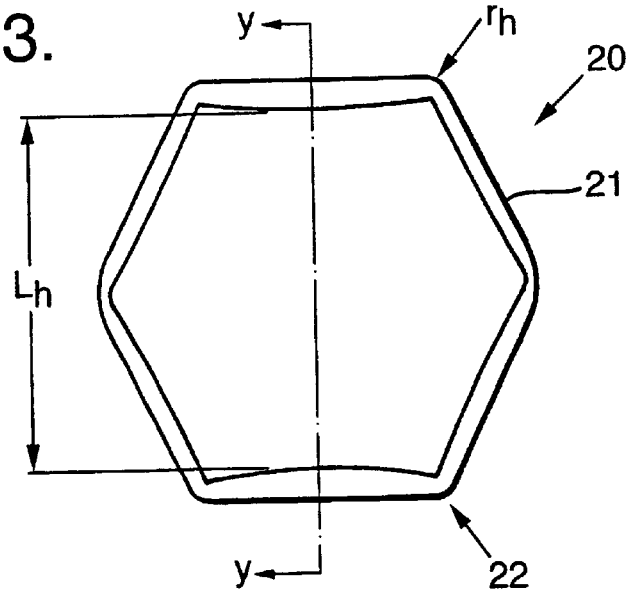
Fig.4.
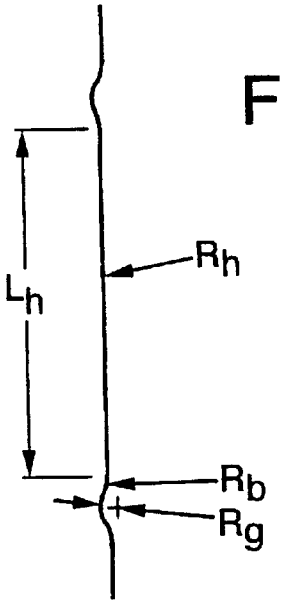

EXPANDED CANS

BACKGROUND OF THE INVENTION

This invention relates to expanded cans. In particular it relates to a can having a cylindrical side wall with a regular pattern of expanded elements. The cylindrical can side wall has either an integral base and a single can end (as in a so-called "two-piece" can) or is closed at both ends (as in a so-called "three-piece" or an aerosol can).

Cans having a patterned side wall have been produced in order to improve resistance against deformation by external pressure. These known cans have pattern elements which are pressed into the side wall of the can blank in order to provide improved axial load or panel performance. Since the elements are only provided for structural reasons, any "pattern" is often covered by a product label. In any case, these cans have only achieved limited shape definition, i.e. a shape which is clearly visible to a consumer, and reduce the capacity of the can of a particular aspect ratio.

EP-A-0 441 618 describes cans having patterned side walls which are typical of those referred to above. The pattern elements of EP-A-0 441 618 are formed entirely by pressing inwardly on the can side wall such that the pattern elements are externally concave with their sides being at the original side wall diameter.

U.S. Pat. No. 3,335,902 describes superimposed axial and circumferential beading rather than pattern elements.

SUMMARY OF THE INVENTION

According to the present invention, there is provided a metal can formed from a can blank having at least a cylindrical side wall, the side wall of the can comprising a regular pattern of individual polygonal pattern elements, in which: the pattern elements are arranged in at least two circumferential rows and at least two longitudinal columns; and each polygon comprises between 3 and 10 sides; characterised in that: at least some of the pattern elements are formed by expanding the cylindrical side wall of the can blank so that the can side wall extends beyond its original radius, each such expanded pattern element having an externally concave radius around its edges and an externally convex radius adjacent the concave radius, towards the centre of the pattern element; in which the concave radius is substantially constant around the element; the size of the convex radius is directly proportional to its distance from the centre of the pattern element; and the expansion of any point on an expanded pattern element is inversely proportional to its distance from the centre of the pattern element.

The Applicant has found that cans according to the present invention have great visual impact without reducing the can capacity of a particular aspect ratio. Furthermore, by varying the convex radius according to its distance from the centre of the element, splitting of the can side wall, especially at any corners of the pattern element, due to expansion is substantially avoided whilst maintaining definition of the pattern element shape.

In a preferred embodiment, any of the pattern elements may include, in addition to one or more expanded regions, one or more parts which are formed by depressing the cylindrical side wall of the can blank. The sides of the pattern elements may be at the original can side wall diameter.

Alternatively, the pattern elements may be curved in outline, for example tear drop shaped, circular, etc.

In one embodiment, when the pattern element is viewed in plan, the sides of any of the pattern elements are linear, curved, or comprise a complex curve. The sides of any of the pattern elements may meet at a radius, the maximum size of which is preferably directly proportional to the size of the pattern element.

The individual pattern elements may touch or overlap each other, or may themselves be separated by spaces either longitudinally or circumferentially or both. One or more spaces between columns of pattern elements may be provided for a logo, print or label.

The patterned side wall may be expanded by anything from 2% to 20%, dependent on pattern element size. Where the can blank has an integral base and side wall, as in a so-called two-piece can, the expansion is preferably not greater than 10%. The maximum expansion for a two piece can is limited by the degree of work hardening of the can side wall. The can blank is usually formed from aluminium or steel or alloys of either of these. The can blank side wall may be between 0.075 mm and 0.15 mm in thickness if made of aluminium, typically about 0.1 mm. If the can blank is of steel, the thickness of the side wall may be between 0.06 mm and 0.18 mm, typically about 0.08 mm. The closed and pressurised can may withstand up to 7 bar without pattern reversal. By pattern reversal is meant that radially inwardly extending parts of the pattern are pushed outwardly by pressure inside the can. This at least diminishes pattern definition and at worst, over 7 bar internal pressure, may result in buckling and/or loss of any visual pattern at all.

In one embodiment, the rows of pattern elements are out of phase with each other such that elements of adjacent rows are displaced longitudinally.

The patterned elements may be positioned anywhere on the can side wall and it may be preferred to include a margin at either or both ends of the side wall. This margin may be the same diameter as the original can blank side wall or may be expanded in the same way as the pattern.

Can expansion may be achieved by any of a variety of known methods such as by using an expanding mandrel, fluid jets, a roller device which rolls around and/or up the inner side wall, or by fluid pressure in a closed can. This last is sometimes referred to as blow forming the fluid is air. In some cases, particularly blow forming, the can is expanded to the shape of a mould.

Preferred embodiments of the invention will now be described, by way of example only, with reference to the drawings, in which:

BRIEF DESCRIPTION OF THE DRAWINGS

FIG. 2 is an enlarged developed view of an element of the pattern of FIG. 1;

FIG. 3 is a developed side view of a second embodiment of pattern element; and FIG. 4 is a section through the pattern element of FIG. 3.

DESCRIPTION OF THE PREFERRED EMBODIMENTS

Figure 1:
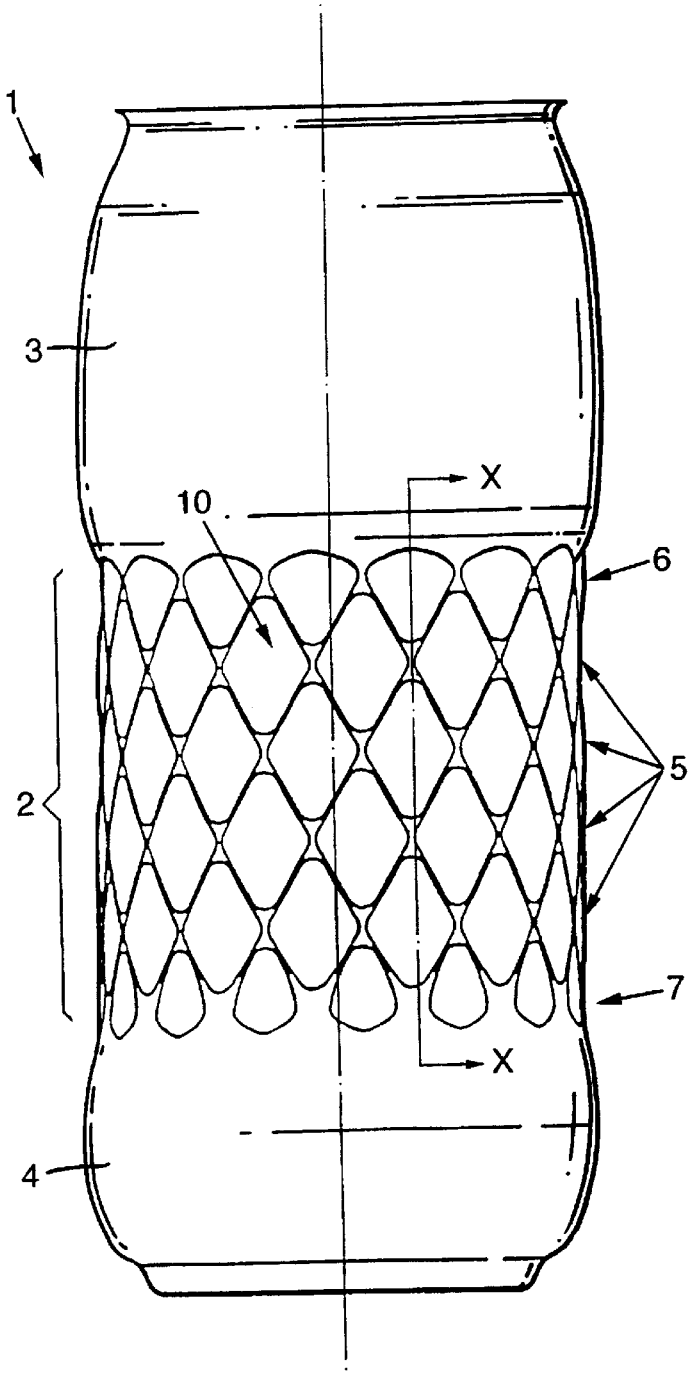
FIG. 1 is a side view of a can having a first pattern.

FIG. 1 shows a can body 1 having a side wall with a regular expanded pattern 2 of diamond-shaped elements in a central region and upper and lower expanded regions 3 and 4. The diamond pattern 2 comprises six circumferential rows, hereafter referred to as "layers". There are four layers 5 having complete diamonds, the extreme layers 6,7 being partial elements which are blended into the side wall above or below the pattern respectively. The pattern extends around the whole circumference of the can body, thereby comprising fifteen complete diamond pattern elements.

In the example shown, the can body blank has a cylindrical side wall of 66 mm diameter. This has been expanded in the centre of the diamonds of the patterned region 2 by 2.25% and in the upper and lower regions 3,4 by 8%. The expansion method of the example was by pressurised fluid such as air. Larger expansion of the pattern elements would be achievable by different expansion methods without splitting the can side wall.

Figure 1A:
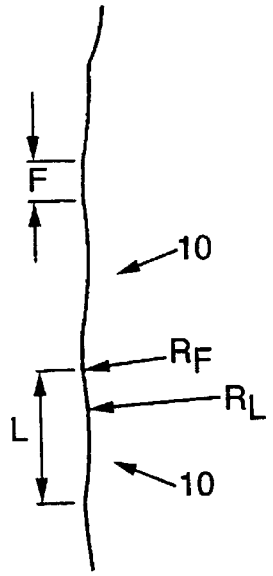

FIG. 1*a* shows the curvature of the pattern elements as a section through X—X of the can side wall, passing through the centre of two pattern elements 10. In this example, it can be seen that the longitudinal central axis L of each diamond is a smooth continuous externally convex, i.e. expanded, curve having a radius $R_L$ of 56 to 57 mm. This curve is blended into a "flat" F, i.e. the original diameter cylindrical side wall, by an externally concave radius $R_F$ of 1 mm.

A side wall of a diamond pattern element 10 of FIG. 1 is shown in FIG. 2. This diamond has straight side walls 11, 8.5 mm in length $\mathbf{1}_s$, which meet at radii r of approximately 2 mm, typically 1.96 mm. The size of these radii r depends on the size of the pattern element, since the elements in this example are small so as to obtain 15 elements around the can circumference, the radii r must be correspondingly small in order not to lose the definition of the pattern element. If these radii were much larger for this size of element then the element would not appear to be diamond-shaped. The axial length $\mathbf{1}_a$ of each of the complete diamonds is 19.25 mm.

The depth of the diamond pattern element may vary along each side so that there is less deformation of the metal of the can at the "corners" 12 where the sides of the pattern elements meet. This depth variation is achieved by varying the size of the convex radius $R_L$ in direct proportion to its distance from the centre of the pattern element. Since the corners 12 are further from the centre than are, for example, the centres of the sides, the value of $R_L$ is greater at the corners and the deformation consequently less severe.

FIGS. 3 and 4 show one of many alternative embodiments of pattern element which are within the scope of the present invention. This pattern element 20 is hexagonal in shape and may comprise part of a regular pattern comprising anything from two such elements around the can circumference up to as many as ten or even more. It will be appreciated that the definition of the shape of the pattern elements will diminish as more are provided around the can side wall since the maximum amount of expansion possible without risk of splitting will decrease as the number of pattern elements increases. The expansion method will also dictate the amount of expansion possible without damage or failure.

In a second example of the present invention, two hexagonal pattern elements 20 as shown in FIGS. 3 and 4 were provided around a 66 mm diameter can body so that effectively two columns of pattern elements were formed. The side wall of the can body was completely covered by the pattern, leaving no margins either end as in the example of FIGS. 1 and 2. This resulted in a regular pattern of two and a half layers of hexagons, one half hexagon being at the can base end in one column and the other half hexagon being at the top of the second column.

These large hexagons were formed with 5% expansion. As in the first example, this expansion was achieved by pressurised fluid but larger amounts of expansion, depending on the expansion method and metal of the can body would be possible.

A side section through the line Y—Y is shown in FIG. 4. As can be seen from this figure, the pattern elements 20 are expanded to a relatively smooth curved central section which may have comprise a curve having a convex radius $R_h$ which varies from 95.5 mm to 1990 mm and is blended into groove-like areas between pattern elements by a convex radius $R_b$ of typically about 8 mm, depending on the amount of expansion. A value of 4 mm, for example, would also provide satisfactory pattern definition. The "grooves" themselves comprise an externally concave radius $R_g$ of typically 2 mm. It is considered likely that a groove radius of less than 2 mm would risk splitting of the can if the can were expanded by air pressure. It should be appreciated that the "base" of the groove constitutes the side of hexagonal pattern element 20 and is at the original can diameter.

The sides 21 of the pattern elements in this example comprise Bezier curves when viewed in plan but other complex curves could be used. The sides 21 meet at a radius which is constantly varying but at the actual corner 22 is about 5 mm. A typical axial length $L_h$ for the hexagonal pattern elements of this example is 45.25 mm.

It will be appreciated that although two specific examples of pattern have been described, numerous alternatives are possible within the scope of the invention. The degree of expansion of the pattern elements may vary in many respects such as the area of individual elements, the expansion method, the can diameter and wall thickness or the material of the can body. Similarly, the curvature of the side wall after such expansion may be varied, particularly where a mould is used, so that any type of curvature, simple or complex, or indeed flat, i.e. constant diameter over a length of side wall is possible within the scope of the claims.

Although a preferred embodiment of the invention has been specifically illustrated and described herein, it is to be understood that minor variations may be made in the apparatus without departing from the spirit and scope of the invention, as defined the appended claims.

What is claimed is:

1. A metal can formed from a can blank (1) having at least a cylindrical side wall, the side wall of the can comprising a regular pattern (2) of individual polygonal pattern elements (10,20), in which:

the pattern elements (10,20) are arranged in at least two circumferential rows (5,6,7) and at least two longitudinal columns; and each polygon (10,20) comprises between 3 and 10 sides;

characterised in that:

at least some of the pattern elements (10,20) are formed by expanding the cylindrical side wall of the can blank so that the can side wall extends beyond its original radius, each such expanded pattern element having an externally concave radius ($R_F$,$R_g$) around its edges and an externally convex radius ($R_L$,$R_h$) adjacent the concave radius, towards the centre of the pattern element;

in which the concave radius ($R_F$,$R_g$) is substantially constant around the element;

the size of the convex radius ($R_L$,$R_h$) is directly proportional to its distance from the centre of the pattern element; and the expansion of any point on an expanded pattern element is inversely proportional to its distance from the centre of the pattern element.

2. A can according to claim 1, in which any of the pattern elements includes one or more parts which are formed by depressing the cylindrical side wall of the can blank.

3. A can according to claim 1, in which the sides of any of the pattern elements are linear, curved, or comprise a complex curve.

4. A can according to claim 1, in which the sides (11,21) of any of the pattern elements meet at a radius (r,$r_h$).

5. A can according to claim 4, in which the maximum size of the radius (r,$r_h$) is directly proportional to the size of the pattern element.

6. A can according to claim 1, in which the maximum side wall expansion is from 3% to 20%.

7. A can according to claim 6, in which the can is a two-piece can and the expansion is between 2% and 10%.

8. A can according to claim 1, in which the can is made of aluminium or aluminium alloy and the side wall is between 0.075 mm and 0.15 mm in thickness, typically about 0.1 mm.

9. A can according to claim 1, in which the can is made of steel or a steel alloy and the thickness of the side wall is between 0.06 mm and 0.18 mm, typically about 0.08 mm.

10. A can according to claim 2, in which the sides of any of the pattern elements are linear, curved or comprise a complex curve.

* * * * *